United States Patent [19]

Nakajima et al.

[11] 4,315,881

[45] Feb. 16, 1982

[54] PROCESS FOR PRODUCING COMPOSITE FIBERS OF SIDE BY SIDE TYPE HAVING NO CRIMP

[75] Inventors: Takayoshi Nakajima, Moriyamashi; Susumu Tomioka, Shigaken, all of Japan

[73] Assignee: Chisso Corporation, Osaka, Japan

[21] Appl. No.: 102,134

[22] Filed: Dec. 10, 1979

[30] Foreign Application Priority Data

Dec. 20, 1978 [JP] Japan ..... 53/157880

[51] Int. Cl.[3] ..... B29F 3/10

[52] U.S. Cl. ..... 264/171; 264/210.8; 264/290.5; 428/373; 428/374

[58] Field of Search ..... 264/171, 210.8, 290.5; 428/373, 374

[56] References Cited

U.S. PATENT DOCUMENTS

| | | | |
|---|---|---|---|
| 3,505,164 | 4/1970 | Oppenlande | 428/394 |
| 3,509,013 | 4/1970 | Oppenlande | 428/394 |
| 3,589,956 | 6/1971 | Kranz et al. | 264/126 |
| 3,595,731 | 7/1971 | Davies et al. | 428/151 |

FOREIGN PATENT DOCUMENTS

| | | | |
|---|---|---|---|
| 2810429 | 9/1978 | Fed. Rep. of Germany | 428/373 |
| 49-101669 | 9/1974 | Japan | 264/171 |
| 50-95519 | 7/1975 | Japan | 264/171 |
| 51-9049 | 3/1976 | Japan | 264/171 |
| 51-64020 | 6/1976 | Japan | 264/171 |
| 52-49372 | 4/1977 | Japan | 264/171 |
| 1446570 | 8/1976 | United Kingdom . | |

*Primary Examiner*—Jay H. Woo

*Attorney, Agent, or Firm*—Fred Philpitt

[57] ABSTRACT

A process for producing side-by-side type composite fibers made of polypropylene-polyethylene which do not have hardly any crimp nor latent crimpability is provided. In said process, a composite spinning is carried out by melt-extrusion by using, as composite components of side by side type, crystalline polypropylene of an intrinsic viscosity (I.V.) of 1.45~2.15 and high density polyethylene if I.V. of 0.85~1.05 under a condition satisfying the relationship of $10{,}500 \geqq DXV \geqq 5{,}139$ (V: take-up speed (m/min); D: denier of taken up unstretched fibers); and stretching the resulting filaments to 3~5 times the original length at a temperature of 90° C. or higher.

1 Claim, 1 Drawing Figure

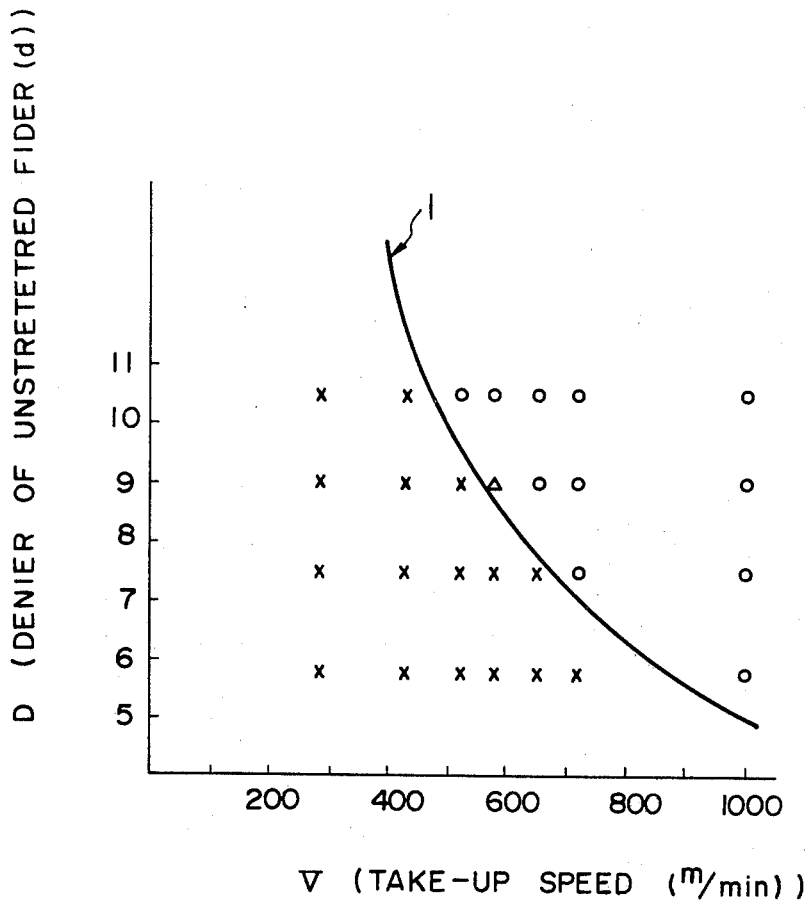
D (DENIER OF UNSTRETETRED FIDER (d))
11
10
9
8
7
6
5
1
200
400
600
800
1000
V (TAKE-UP SPEED (m/min))

PROCESS FOR PRODUCING COMPOSITE FIBERS OF SIDE BY SIDE TYPE HAVING NO CRIMP

FIELD OF THE INVENTION

This invention relates to a process for producing side by side type composite fibers consisting of composite components of polypropylene and polyethylene, and more particularly it relates to a process for producing side by side type composite fibers which do not show hardly any crimp and hence are suitable for either wet or dry type non-woven fabrics.

BACKGROUND OF THE INVENTION

Techniques for producing non-woven fabrics which use melt-adhesive composite fibers consisting of composite components having a melting point difference therebetween, and making use of their crimpability and adhesiveness, are disclosed in U.S. Pat. Nos. 3,595,731 and 3,589,956. Further, composite fibers consisting of a combination of different polyolefin components, and aiming at crimpability, but not aiming at adhesiveness due to difference of melting points, are disclosed in U.S. Pat. No. 3,505,164, No. 3,509,013, etc.

These composite fibers consisting of different component polymers cause a difference in percentage elastic shrinkage, between the two components, resulting in a large number of crimps if they are subjected to stretching operation during their production process (i.e. after stretching, crimp development occurs in a relaxed state). Further, if heat treatment is carried out making use of the difference in percentage thermal shrinkage, between two components, such composite fibers have a property of developing crimps, i.e. these composite fibers have a latent thermal crimpability. The above-mentioned U.S. Pat. No. 3,505,164, U.S. Pat. No. 3,509,013, etc. propose to obtain preferable crimped composite fibers, making use of such a property. Further, U.S. Pat. No. 3,595,731 proposes obtaining a non-woven fabric having sufficient interfilamentary entanglements, by making use of their latent crimpability.

However, it has been well known that composite fibers having superior crimpability are accompanied with a great deal of shrinkage simultaneously with the development of crimps. When a web is made into a non-woven fabric, generation of crimps improves interfilamentary entanglements, yielding an elastic non-woven fabric, but, on the other hand, when a web is continuously made into a non-woven fabric, the web is accompanied with a great deal of shrinkage at the time of development of crimps, and hence the resulting web is deficient insofar as uniformity of width thickness and density are concerned. Further, when a web is subjected to heat-treatment in order to obtain a non-woven fabric like the one used for kilting, in which only the surface portion is melt-adhered interfilamentarily, there occurs a drawback in that shrinkage appears only on the surface layer, resulting in the forming of wrinkles. When such conventional composite fibers having a latent crimpability are used, it is the present status of this art that it is impossible to make the most of their characteristic feature, because of the above-mentioned drawbacks in the case of mass production, though a characteristic non-woven fabric may be obtained in case of a laboratory preparation; hence it is difficult to make them into a commercial product. According to the above-mentioned U.S. Pat. No. 3,589,956, composite fibers are annealed in a free state, before they are made into a non-woven fabric, for the purpose of preventing such a thermal shrinkage accompanying the development of latent crimps at the time of processing. However, the process of this patent is undesirable because of its complication and interfilamentary adhesion occurring at the time of annealing.

Further, in a process of producing a non-woven fabric in a wet manner, composite fibers having crimps are also undesirable because it is difficult to disperse these composite fibers uniformly in water, and hence it is impossible to obtain a uniform, wet type non-woven fabric.

The object of the present invention is to provide a process for producing polypropylene-polyethylene composite fibers which do not form crimp nor have latent crimpability almost at all and which is applicable to both wet type and dry type non-woven fabrics.

SUMMARY OF THE INVENTION

The present invention resides in the following process:

In the production of side by side type composite fibers by way of composite-spinning of polypropylene and polyethylene as composite components, in side by side manner, followed by stretching, the improvement which comprises;

leading a melt of a crystalline polypropylene having an intrinsic viscosity of 1.45~2.15, preferably 1.45~2.10, as a polypropylene component, and a melt of a high density polyethylene having an intrinsic viscosity of 0.85~1.10, preferably 0.85~1.05, into a spinnerette for side by side type composite fibers; extruding the melts therethrough;

taking up the resulting fibers so as to satisfy the following condition:

$$D \times V > 5{,}000$$

(wherein V represents take-up speed (m/min) and D represents denier of taken up unstretched fibers), and stretching the resulting fibers to 3~5 times the original length at a temperature of 90° C. or higher at which the fibers do not melt-adhere to each other.

Crystalline polypropylene referred to herein means crystalline polymers consisting mainly of propylene component (e.g. 80% by weight or more), and includes not only propylene homopolymer but also its copolymers with other monomers such as ethylene, and in the present invention, those having an intrinsic viscosity of 1.45~2.15, preferably 1.45~2.10, are employed.

Further, polyethylene employed as another component refers to herein polymers consisting mainly of ethylene component (e.g. 80% by weight or more), or their copolymers, and in the present invention, those having an intrinsic viscosity of 0.85~1.10, preferably 0.85~1.05, are employed.

As for polypropylene and polyethylene as two components constituting the composite fibers of the present invention, polypropylene may be added to polyethylene as its counterpart composite component; or polyethylene, to polypropylene as its counterpart composite component, so long as it is in the range where the object of the present invention can be attained, and further, additives which have been known in the fields of the art, such as heat stabilizer, light stabilizer resistant to discoloration by gas, titanium dioxide, pigment, etc., may be added as a third component.

In producing the composite fibers of the present invention, conventionally known spinning apparatuses and stretching apparatuses may be employed.

As for the temperature of melts for the melt-spinning, generally the temperature of the melt of the polypropylene component is in the range of 200° to 350° C. and the melt of the polyethylene component is in the range of 170° to 300° C.

As for the spinnerette, conventional spinnerettes from which the two components are extruded in side by side manner are employed, and the ratio by weight of the two components in a filament is in the range of 30:70 to 70:30, and good results are obtained if a preferable ratio of 40:60 to 60:40 is selected.

The side by side type composite fibers obtained according to the process of the present invention hardly show crimps nor latent thermal crimpability, and also no detachment of the two components is observed. Thus, the composite fibers can be used with preference for wet type non-woven fabric, not to mention for dry type one, and superior non-woven fabrics, which can constitute layers of fiber collection having no unevenness, and do not show shrinkage unevenness by heat treatment, can be obtained. Moreover, these composite fibers can be easily produced by means of usual apparatus for producing side by side composite fibers, and also thin products of 3 denier or less can be easily produced.

BRIEF DESCRIPTION OF THE DRAWING

The accompanying drawing shows a relationship between a combination of take-up speed (m/min) with denier of unstretched fibers, and number of crimps, wherein numeral 1 shows a curve of $D \times L = 5000$.

PREFERRED EMBODIMENT OF THE INVENTION

The present invention will be illustrated in more detail by way of a number of Examples and Comparative examples.

In advance of this illustration, measurement methods and definitions of various characteristics will be mentioned below.

Number of crimps: A photograph is taken under an initial load of 10 mg/d, and from this photograph is read number of crimps, which, in turn, are converted into number of crimps per inch.

Percentage thermal shrinkage of web: A parallel web of 25 cm×25 cm is heat-treated in free state, and the length (a cm) in the direction of fiber axis, of the heat-treated web is measured, and the above percentage is calculated according to the following formula:

Percentage thermal shrinkage of web=

$$\left(1 - \frac{a}{25}\right) \times 100$$

Through this percentage thermal shrinkage of web, it is possible to know the extent of latent thermal crimpability of the composite fibers.

EXAMPLES AND COMPARATIVE EXAMPLES

1. Crystalline polypropylenes having various intrinsic viscosities (abbreviated hereinafter to PP) and high density polyethylenes having various intrinsic viscosities (abbreviated hereinafter to PE) as two composite components, were extruded through a spinnerette for side by side type composite spinning, having 240 holes and a hole diameter of 1.0 mm, at a temperature of the melt on the PP side, of 300° C. and that on the PE side, of 250° C., in a composite ratio of 50:50, and taken up at a take-up speed of 514 m/min ($D \times V = 5397$), to obtain unstretched fibers each having 10.5 deniers.

The unstretched fibers were stretched in a stretching ratio of 3.8 times and at a stretching temperature of 100° C. The resulting stretched fibers were subjected to measurement of the number of crimps. Further, the stretched fibers were subjected to a mechanical crimp by passing them through a stuffer box type crimper to give 13~14 crimps/inch, and cut to a length of 64 mm to obtain staple fibers. A carded web therefrom was heat-treated at 145° C. for 5 minutes, and the resulting web was subjected to measurement of the percentage thermal shrinkage. The results are shown in Table 1. The evaluation symbols in this Table have the following meanings (this applies also to the subsequent Tables):

As for number of crimps,
o: 0~1 crimp/25 mm
Δ: 2~3 crimps/25 mm
×: 4 or more crimps/25 mm
As for percentage thermal shrinkage of web,
o: 10% or less
Δ: 11~15%
×: 16% or more Composite fibers having 3 crimps or less/25 mm (i.e. symbols o and Δ) and a percentage thermal shrinkage of 10% or less (i.e. symbol o) meet the object of the present invention.

TABLE 1

| PP (η) | PE (η) 1.20 | 1.04 | 0.97 | 0.90 | 0.86 | 0.83 |
|---|---|---|---|---|---|---|
| 2.32 | x | x | x | x | x | x |
| | Δ | o | o | o | o | o |
| 2.13 | x | Δ | o | o | o | o |
| | x | o | o | o | o | o |
| 1.90 | x | o | o | o | o | o |
| | x | Δ | o | o | o | o |
| 1.60 | x | o | o | o | o | o |
| | x | x | Δ | o | o | o |
| 1.47 | x | o | o | o | o | o |
| | x | x | x | Δ | o | o |
| 1.40 | x | o | o | o | o | o |
| | x | x | x | x | x | Δ |

In the above Table, left upper part above a diagonal shows number of crimps and right lower part shows percentage thermal shrinkage of web.

In Table 1, in case of the use of PP having an intrinsic viscosity of 1.47~2.13 and PE having that of 0.83~1.04 as raw materials of composite components, composite fibers which do not show crimp almost at all are obtained, and also a web obtained therefrom has a low percentage thermal shrinkage.

Further, experiments were carried out under the same conditions as that of the above-mentioned, except that the take-up speed was changed to 1,000 m/min. As a result, in case of the use of PP having an intrinsic viscosity of 1.40 combined with PEs having various intrinsic viscosities, as the other composite component and also in case of the use of PE having an intrinsic viscosity of 0.83 combined with PPs having various intrinsic viscosities, as the other component, fiber breakage occurred in all of these cases, whereas the same results as those in Table 1 were obtained in other combinations.

2. By using PP having an intrinsic viscosity of 1.90 and PE having that of 0.97, as composite components, experiments were carried in the same manner as those in the above-mentioned experiments 1 except that the take-up speed was varied as shown in Table 2, to obtain unstretched fibers each having 10.5 deniers, which were then stretched under conditions shown in Table 2. The resulting stretched fibers were subjected to measurement of the number of crimps, and webs obtained therefrom were subjected to measurement of the percentage thermal shrinkage, both in the same manner as in the above-mentioned experiments 1. The results are shown in Table 2.

TABLE 2

| Take-up speed m/min (D × V) | Stretching temperature 85° C. Stretching ratio 2 | 3 | 4 | 5 | 6 | Stretching temperature 95° C. Stretching ratio 2 | 3 | 4 | 5 | 6 |
|---|---|---|---|---|---|---|---|---|---|---|
| 286 | x | x | x | x | x | x | x | x | x | x |
| (3003) | x | x | x | x | x | x | o | o | o | o |
| 429 | x | x | x | x | x | x | x | x | x | x |
| (4505) | x | x | x | x | x | x | o | o | o | o |
| 514 | x | x | x | x | x | x | Δ | o | Δ | x |
| (5397) | x | x | x | x | x | x | o | o | o | o |
| 571 | x | x | x | x | x | x | o | o | o | x |
| (5996) | x | x | x | x | x | x | o | o | o | o |
| 643 | x | x | x | x | x | x | o | o | o | x |
| (6752) | x | x | x | x | x | x | o | o | o | o |
| 714 | x | x | x | x | x | x | o | o | o | x |
| (7497) | x | x | x | x | x | x | o | o | o | o |

| Take-up speed m/min (D × V) | Stretching temperature 100° C. Stretching ratio 2 | 3 | 4 | 5 | 6 |
|---|---|---|---|---|---|
| 286 | x | x | x | x | x |
| (3003) | x | o | o | o | o |
| 429 | x | x | x | x | x |
| (4505) | x | o | o | o | o |
| 514 | x | o | o | o | x |
| (5397) | x | o | o | o | o |
| 571 | x | o | o | o | x |
| (5996) | x | o | o | o | o |
| 643 | x | o | o | o | x |
| (6752) | x | o | o | o | o |
| 714 | x | o | o | o | x |
| (7497) | x | o | o | o | o |

It is known from Table 2 that the percentage thermal shrinkage of web is reduced at a stretching temperature of 95° C. or higher and in a stretching ratio of 3 times or higher, and when conditions of a take-up speed of 514 m/min and a stretching ratio of 6 times or lower are added to the above-mentioned stretching conditions, the number of crimps appearing through relaxation after stretching becomes nearly zero.

3. (1) Experiments were carried out in the same manner as in the above-mentioned experiments 2 (but adding the condition of a take-up speed of 1000 m/min) except that the denier of taken-up unstretched fibers was made to have various values, to obtain unstretched fibers of various deniers, which were then stretched under conditions of a stretching temperature of 100° C. and a stretching ratio of 3.8 times, and the resulting stretched fibers were evaluated in the same manner as in the above-mentioned experiment 2. The results are shown in Table 3.

TABLE 3

| Denier of unstretched fibers | (Numeral figures within the parenthese : D × V) Take-up speed m/min 286 | 429 | 514 | 571 | 643 | 714 | 1000 |
|---|---|---|---|---|---|---|---|
| 5.8 | x | x | x | x | x | x | o |
| | o | o | o | o | o | o | o |
| | (1659) | (2488) | (2981) | (3312) | (3729) | (4141) | (5800) |
| 7.5 | x | x | x | x | x | o | o |
| | o | o | o | o | o | o | o |
| | (2145) | (3218) | (3855) | (4283) | (4823) | (5355) | (7500) |
| 9.0 | x | x | x | Δ | o | o | o |
| | o | o | o | o | o | o | o |
| | (2574) | (3861) | (4626) | (5139) | (5787) | (6426) | (9000) |
| 10.5 | x | x | o | o | o | o | o |
| | o | o | o | o | o | o | o |
| | (3003) | (4505) | (5397) | (5966) | (6752) | (7497) | (10500) |

(2) The unstretched fibers obtained in the above-mentioned experiments (1) were stretched under conditions of a stretching temperature of 90° C. and a stretching ratio of 5 times, and the resulting unstretched fibers were evaluated in the same manner as in the above-mentioned experiments (1). The results are shown in Table 4.

TABLE 4

| Denier of unstretched fibers | Take-up speed m/min 286 | 429 | 514 | 571 | 643 | 714 | 1000 |
|---|---|---|---|---|---|---|---|
| 5.8 | x | x | x | x | x | x | o |
| | o | o | o | o | o | o | |
| 7.5 | x | x | x | x | x | Δ | o |
| | o | o | o | o | o | o | o |
| 9.0 | x | x | x | Δ | o | o | o |
| | o | o | o | o | o | o | o |
| 10.5 | x | x | Δ | o | o | o | o |

TABLE 4-continued

| Denier of unstretched fibers | Take-up speed m/min | | | | | | |
|---|---|---|---|---|---|---|---|
| | 286 | 429 | 514 | 571 | 643 | 714 | 1000 |
| | o | o | o | o | o | o | o |

The results of the above-mentioned experiments (1) and (2) (Table 3 and Table 4) are almost the same. From this fact, it is known that the percentage thermal shrinkage of web becomes low only if the combination of the intrinsic viscosities of the composite components and the stretching conditions are satisfied, as seen in Table 1 and Table 2, irrespective of the denier of unstretched fibers and the take-up speed at the time of spinning. On the other hand, it is also known that in order to reduce the number of naturally developed crimps down to zero, the take-up speed at the time of spinning should be increased, in accordance with reduction in the denier of unstretched fibers.

When the data of the number of crimps in Table 3 (100° C., stretching to 3.8 times) are plotted, the accompanying drawing is obtained. Numeral 1 in the drawing shows a curve in the case of $D \times V = 5000$, and it is clear that the range of non-crimp is present at the right-upper part above the curve as a boundary. Namely, unless the take-up speed (V) is increased in accordance with reduction in the denier of composite fibers, it is impossible to obtain composite fibers having no crimp.

The reason that such optimum stretching ratio and high temperature stretching are present, may be presumed as follows, although the correctness of such a presumption has no influence upon the value of the present invention:

When unstretched fibers which are not crystallized almost at all are stretched, crystallization advances during the stretching step, in accordance with orientation of their molecular chains. In this case, if the stretching ratio is low, a portion where a molecular orientation has occurred is coexistent with a portion where a molecular orientation does not yet occur, and also their crystallization is incomplete and uniform fibers are not formed; hence such composite fibers have many crimps and web prepared therefrom is reduced in the thermal shrinkage. Accordingly, it is considered that a stretching ratio of 3 times or more is necessary. On the other hand, if the stretching ratio exceeds 6 times, crystallization due to orientation scarcely advances; also strain remaining in the molecular chains increases; and crimps develop due to the difference between the strain of PP and that of PE. For such reason, it is considered that an optimum stretching ratio is present. As for the stretching temperature, it is considered that, by carrying out stretching at a temperature above the vicinity of their softening point, the molecular chains are oriented in the fiber axis direction and crystallized; hence the number of crimps is few, and also the thermal shrinkage of web is small.

What is claimed is:

1. In the production of side-by-side type composite fibers by way of composite melt-spinning of polypropylene and polyethylene as composite components in side-by-side manner, followed by stretching, the improvement which comprises:

(a) passing a melt of a crystalline polypropylene having an intrinsic viscosity of 1.45–2.15 and a melt of a high density polyethylene having an intrinsic viscosity of 0.85–1.05 into a spinnerette for the production of side-by-side type composite fibers;

(b) extruding said melts through the spinnerette so that the ratio by weight of said polypropylene component to said polyethylene component in the resulting side-by-side composite fiber is within the range of 40:60 to 60:40, (c) taking up the resulting composite side-by-side fiber so as to satisfy the following condition: $10{,}500 \geqq D \times V \geqq 5{,}139$ wherein V represents take-up speed in m/min and D represents the denier of the taken up unstretched composite fibers, and (d) stretching the resulting composite side-by-side fibers to 3–5 times their original length at a temperature above 90° C. and below that at which the fibers melt-adhere to each other.

* * * * *